US006464619B1

(12) United States Patent
Bondi

(10) Patent No.: US 6,464,619 B1
(45) Date of Patent: Oct. 15, 2002

(54) TACTILE PLAY STRUCTURE

(76) Inventor: Anthony Bondi, 1311 S. 15th St., Las Vegas, NV (US) 89104

( * ) Notice: Subject to any disclaimer, the term of this patent is extended or adjusted under 35 U.S.C. 154(b) by 0 days.

(21) Appl. No.: 09/540,725

(22) Filed: Mar. 31, 2000

(51) Int. Cl.[7] ..... A63B 17/00

(52) U.S. Cl. ..... 482/35; 482/36; 472/136; 446/476

(58) Field of Search ..... 482/23, 24, 35, 482/36, 37, 94, 148; 434/433; 472/136, 137, 48; 446/476, 491

(56) References Cited

U.S. PATENT DOCUMENTS

| | | | | | |
|---|---|---|---|---|---|
| 1,634,312 | A | | 7/1927 | Zecchino | |
| 2,255,714 | A | | 9/1941 | Rodelli | |
| 2,884,054 | A | | 4/1959 | Bryant | |
| 3,008,711 | A | | 11/1961 | Dillon | |
| 3,642,277 | A | * | 2/1972 | Gersten | 272/60 |
| 3,643,942 | A | | 2/1972 | Williams | |
| 3,756,593 | A | | 9/1973 | Lehr | |
| 3,809,144 | A | | 5/1974 | Garufo | |
| 3,850,428 | A | | 11/1974 | Zuber | |
| 3,977,458 | A | | 8/1976 | Kuen | |
| 4,161,998 | A | * | 7/1979 | Trimble | 182/90 |
| 4,289,190 | A | | 9/1981 | Catan | |
| 4,719,957 | A | | 1/1988 | Strelnieks | |
| 4,878,532 | A | | 11/1989 | Strelneiks | |
| 4,965,701 | A | | 10/1990 | Voland | |
| 5,330,400 | A | * | 7/1994 | Huberman | 482/35 |
| 5,461,745 | A | * | 10/1995 | Nittoli | 15/97.3 |
| 5,605,035 | A | * | 2/1997 | Pethrick et al. | 57/200 |
| 5,643,149 | A | * | 7/1997 | Grimaldi et al. | 482/82 |
| 5,649,867 | A | | 7/1997 | Briggs | |
| 5,820,472 | A | | 10/1998 | Briggs | |
| 6,095,950 | A | * | 8/2000 | Katz | 482/35 |

* cited by examiner

*Primary Examiner*—Jerome W. Donnelly
*Assistant Examiner*—Tam Nguyen
(74) *Attorney, Agent, or Firm*—Quirk & Tratos

(57) ABSTRACT

A play structure having a header connecting the tops of two side supports such that the side supports are spaced to define a pathway. Streamers hang from the header into the pathway and textured protrusions attached to the side supports extend into the pathway. The streamers may be bead chain, plastic strips, or the like. The textured protrusions may be spheres, feathers, fibrous bristles, or the like.

12 Claims, 7 Drawing Sheets

14
24
12
22
16
12
18
10
12

14
28
12
22
16
12
18
10
12

TACTILE PLAY STRUCTURE

FIELD OF THE INVENTION

The present invention is directed to play structures. Specifically, the present invention is a play structure providing an interactive tactile experience to the user.

BACKGROUND OF THE INVENTION

Play structures and playground equipment is well known in the art. Some well known examples include conventional swing sets, monkey bars, seesaws, slides and the like. However, many of these play structures are directed to physical activity and are less concerned with a interactive tactile experience.

For example, Lehr, U.S. Pat. No. 3,756,593 discloses playground equipment including a dome, a panel with apertures, and a plurality of hanging bags. However, the bags are directed for use as swings and the panel with apertures and dome are directed for climbing.

Likewise, Briggs, U.S. Pat. No. 5,649,867 and U.S. Pat. No. 5,820,472 disclose a water play structure having a pipe structure with a number of sprinkler heads. This play structure is intended as a low-cost substitute for a trip to the water park and, as such, requires special set-up and preparation, such as wearing a swimming suit, for use.

Likewise, Briggs, U.S. Pat. No. discloses a water play structure having a pipe structure with a number of sprinkler heads. This play structure is intended as a low-cost substitute for a trip to the water park and, as such, requires special set-up and preparation, such as wearing a swimming suit, for use.

Therefore, it can be seen that there is a need in the art for a play structure that provides users with an interactive tactile experience.

SUMMARY OF THE INVENTION

A play structure includes two side supports. In an optional embodiment, the side supports are substantially the same height and are disposed substantially parallel to one another in a substantially vertical orientation. The side supports may optionally include feet disposed at their base to maintain the side supports vertical. A header connecting the tops of the side supports braces the side supports and spaces the side supports to define a pathway. A plurality of streamers hang from the header into the pathway. The streamers may be bead chain or plastic strips. Additionally, a plurality of textured protrusions, such as textured spheres, feathers, bristles, or the like, attached to the side supports extend into the pathway.

It is an object of the present invention to provide an interactive tactile play structure.

DESCRIPTION

Figure 1:
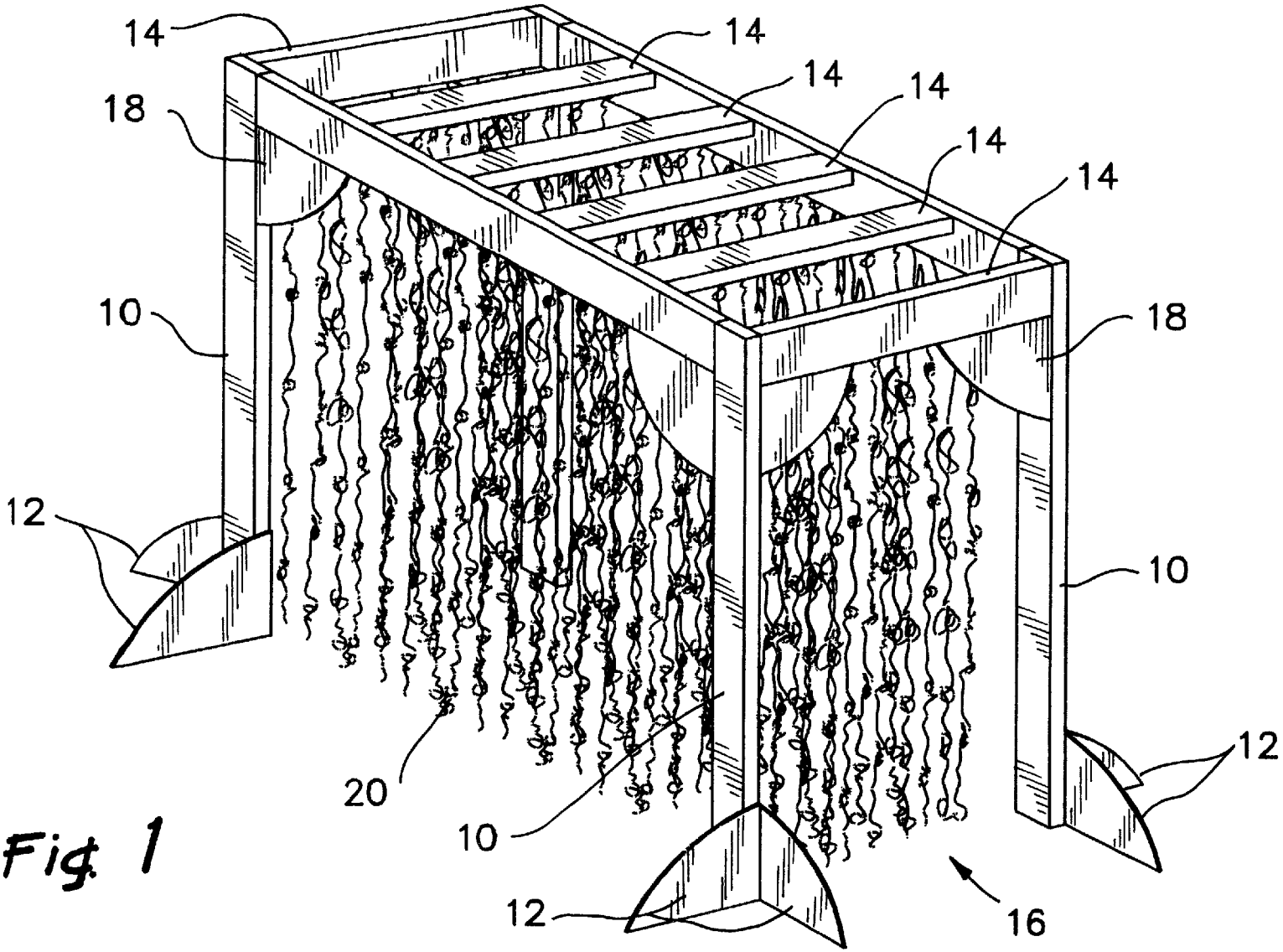
FIG. 1 is an elevated perspective view of a component of a device according to an embodiment of the present invention.

Reference is now made to the figures wherein like parts are referred to by like numerals throughout. Referring to FIGS. 1–5, the device of the present invention includes two side supports 10. Although the side supports 10 could be oriented in any fashion, the supports 10 are optionally substantially vertical, substantially parallel, and substantially the same height. Additionally, the supports 10 may optionally include feet 12 to maintain the supports 10 in the intended orientation. The tops of the supports 10 are connected by a header 14. The supports 10 are spaced from one another to define a pathway 16 that is suitable for moving through. The header 14 may additionally be secured by corner brackets 18. The pathway 16 may be of a height to allow walking, however, it is contemplated that the pathway 16 may be sized for crawling, kneeling, or the like. Likewise, the size of the intended users may influence the height of the pathway 16. The supports 10 may cooperate with other supports 10 and other headers 14 to form an extended pathway 16 as shown in FIG. 5. The supports 10 and header 14 may be made of any material including, for example, wood, plastic, and the like.

Referring again to FIG. 1, extending downwardly from the header 14 or headers 14 are a plurality of streamers 20. The streamers 20 are flexible to allow users to pass through unimpeded. The streamers 20 are any flexible material including, for example, bead chain, plastic strips, or the like.

Figure 2:
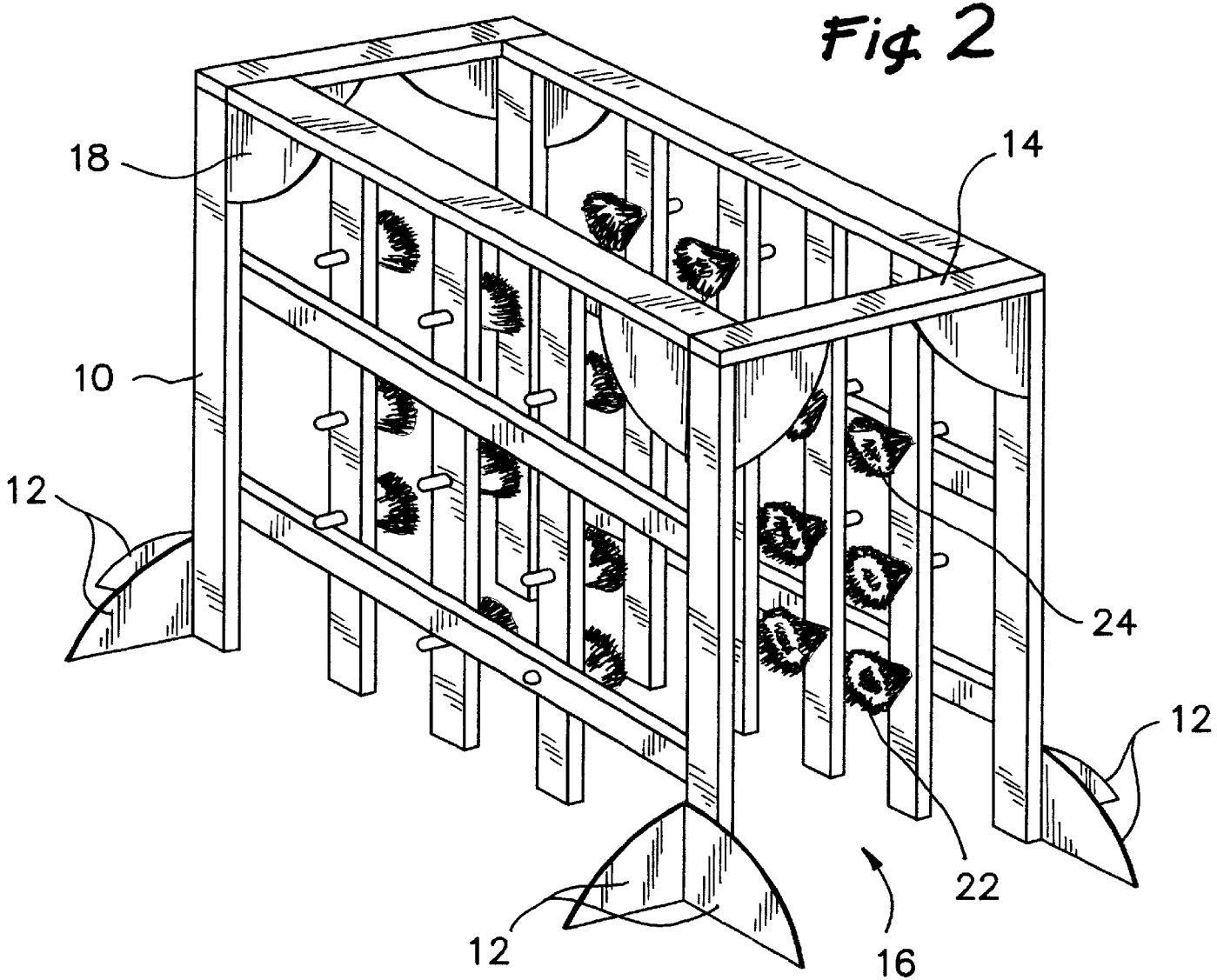
FIG. 2 is an elevated perspective view of a component of a device according to an embodiment of the present invention.
Figure 3:
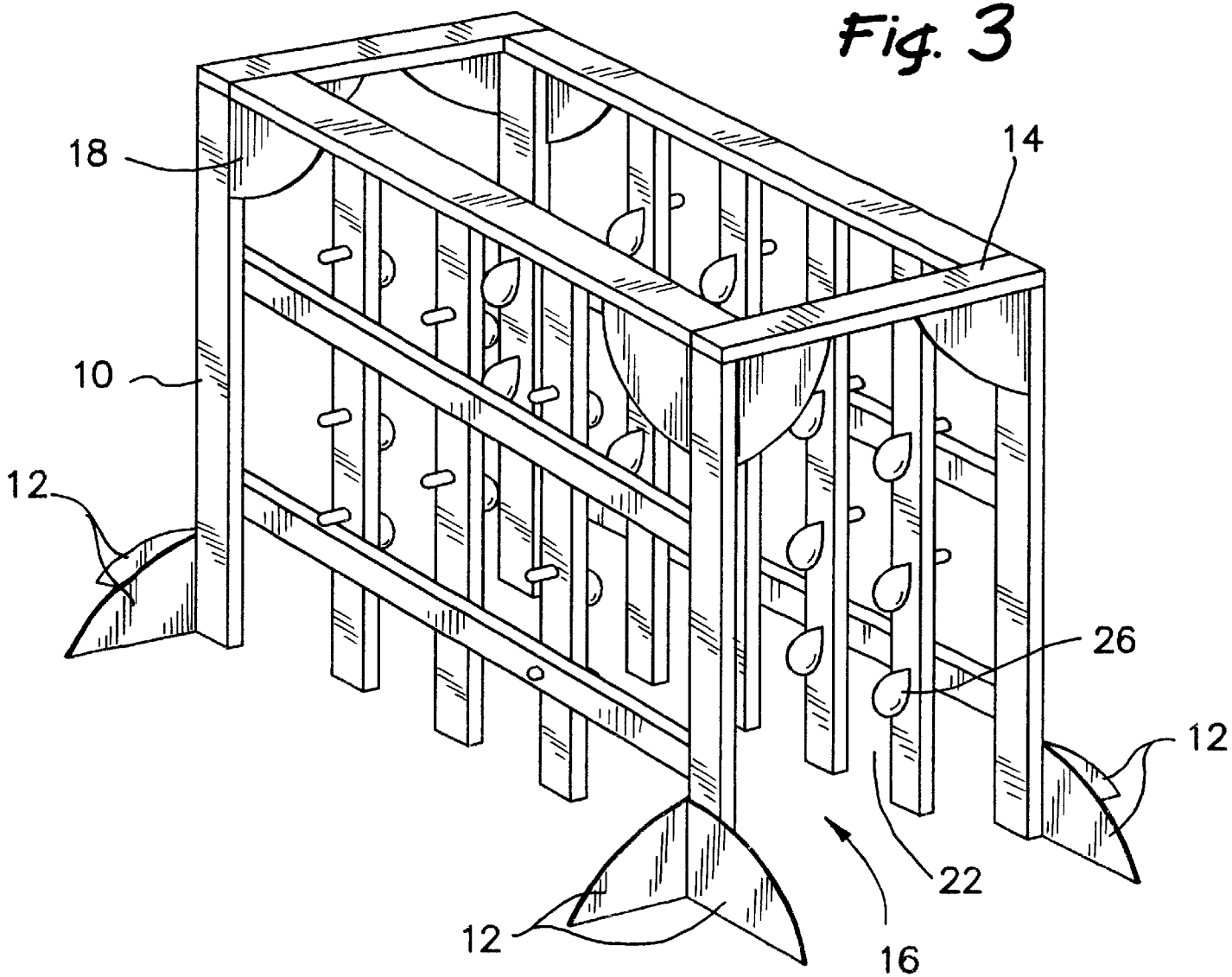
FIG. 3 is an elevated perspective view of a component of a device according to an alternate embodiment of the present invention.
Figure 4:
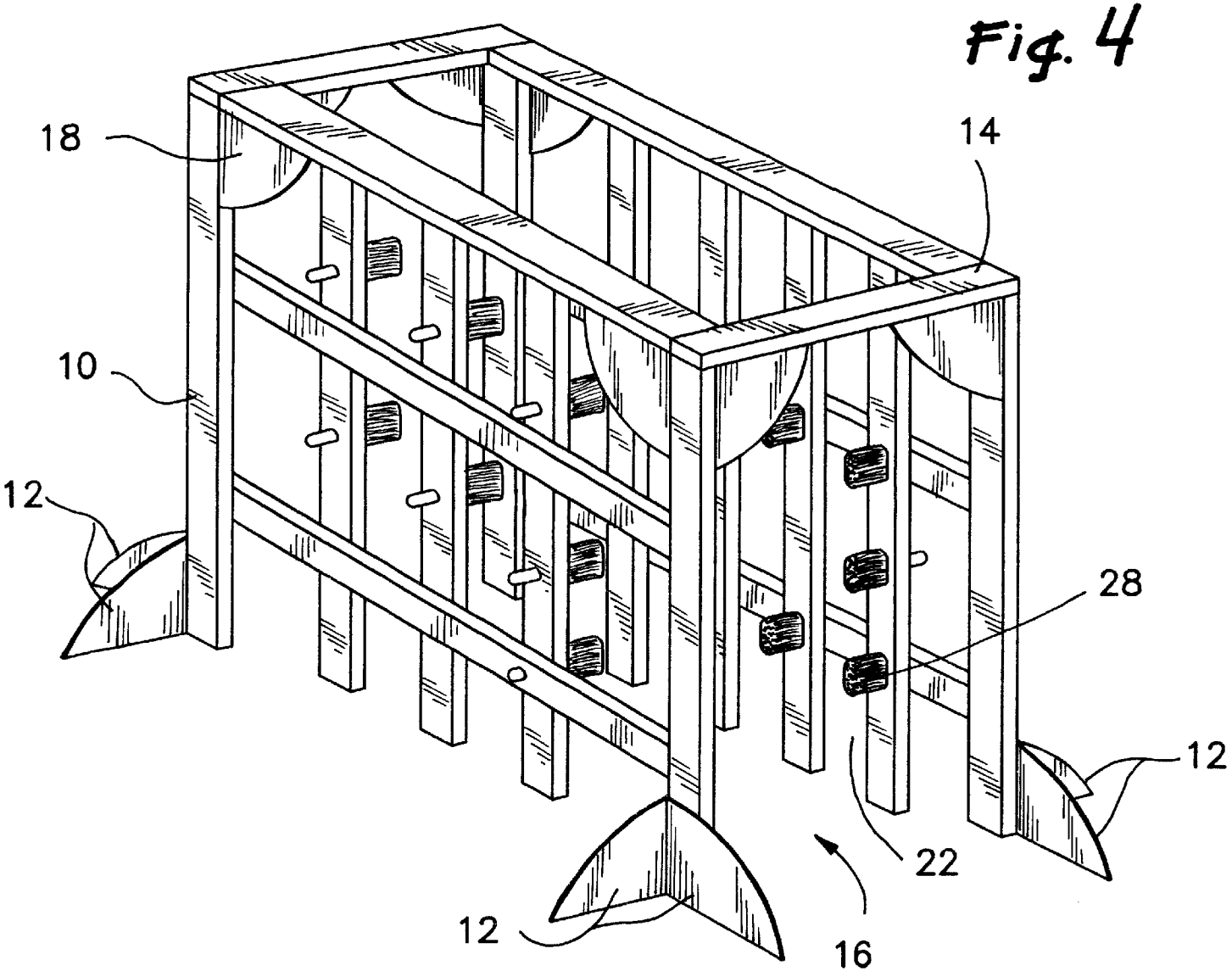
FIG. 4 is an elevated perspective view of a component of a device according to an alternate embodiment of the present invention.
Figure 5:
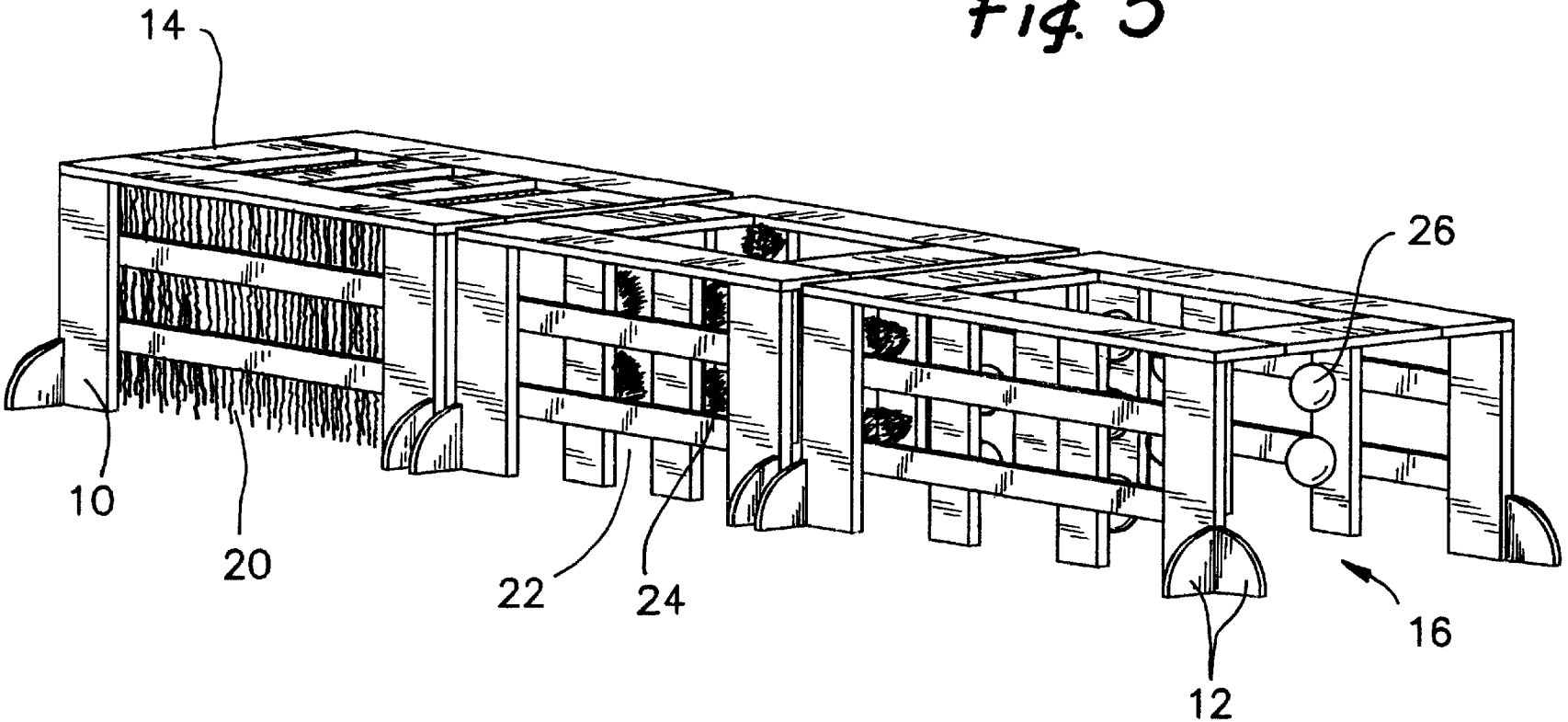
FIG. 5 is an elevated perspective view of the components of FIGS. 1–3 assembled into an extended pathway.

The supports 10 supporting the streamers 20, or separate additional supports 10 as shown in FIGS. 2–4, retain textured protrusions 22 that extend into the pathway 16. As shown in the figures, the protrusions 22 may include feathers 24, as shown in FIG. 2, may be spherical 26, as shown in FIG. 3, may include fibrous bristles 28, as shown in FIG. 4, or the like. For example, feather dusters 24, paint brushes 28, balls 26, balloons 26, and the like could extend from the supports 10 into the pathway 16. Additionally, these may be mixed to provide a variety. It should be noted that the textured protrusions 22 could include any texture known in the art and should not be limited to the examples presented herein. It is worth noting that a plurality of pathway 16*s* could be interconnected or placed adjacent to one another to create an extended pathway 16 as shown in FIG. 5.

Figure 6A:
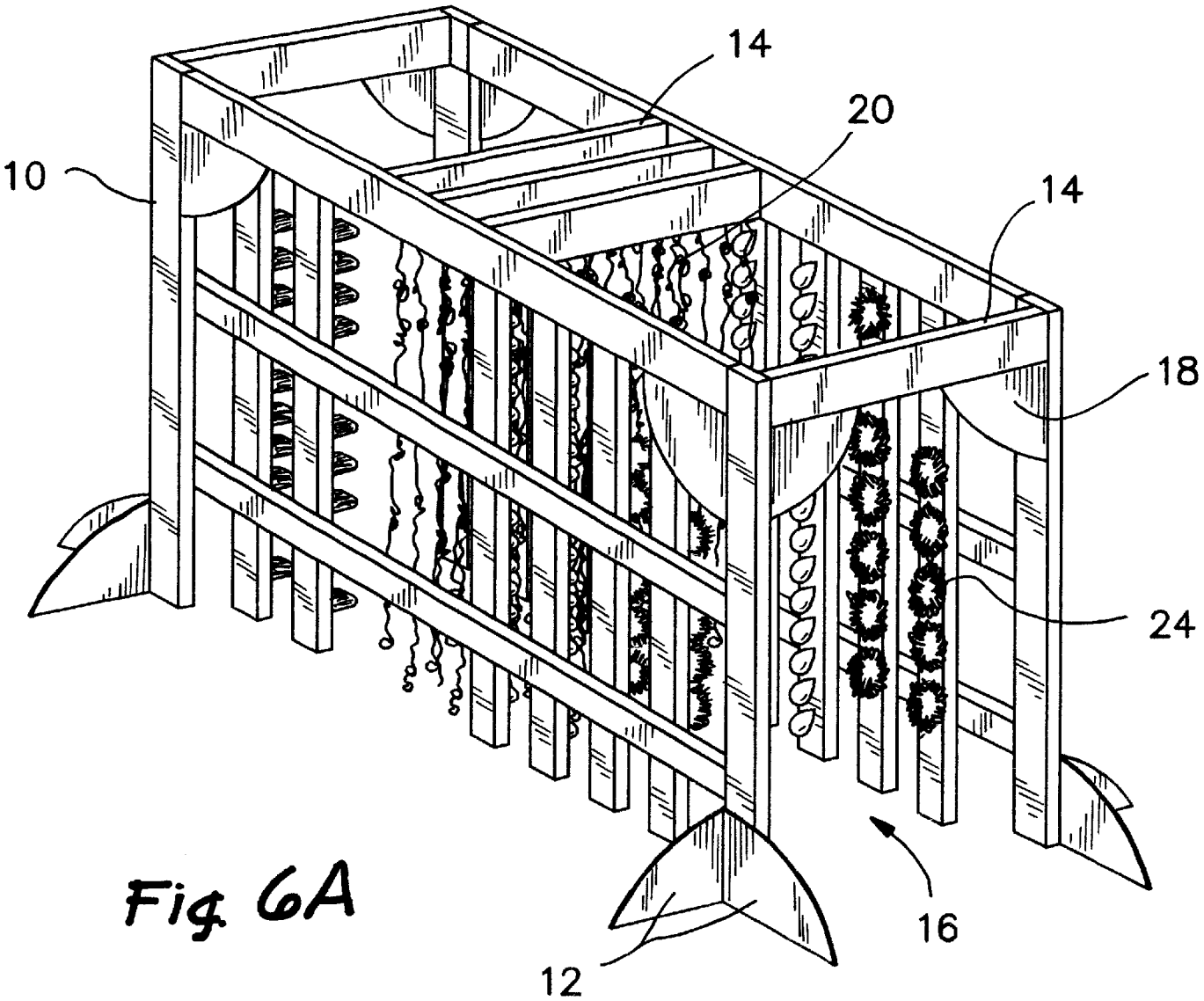
FIG. 6 is an elevated perspective view of a plurality of streamers and textured protrusions assembled into a pathway defined by the present invention.
Figure 6B:
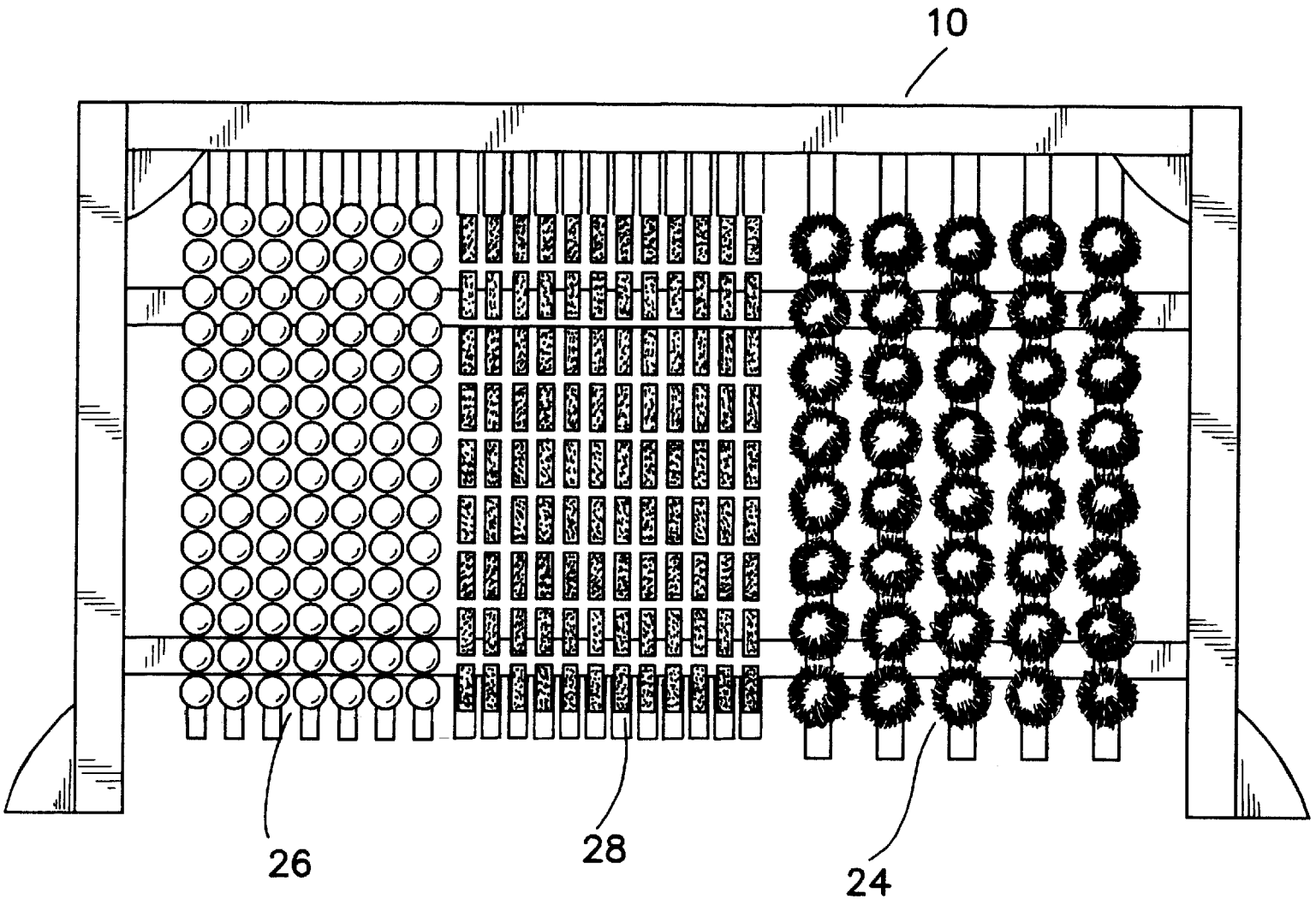

Now referring to FIG. 6, the textured protrusions 22, include feather dusters 24, paint brushes 28 and balls 26 in a dense pattern covering an inner surface of the support 10. While not shown, the opposite support 10 will be covered in the same manner. FIG. 6 illustrates a representative number of textured protrusions 22 which may be used in conjunction with the present invention. However, the exact number of protrusions 22 used may vary and does not limit the scope of the present invention.

In use, a user traverses the pathway 16 between the supports 10. During the traverse, the user experiences a variety of tactile sensations as each textured protrusion 22 or streamer 20 is passed.

While certain embodiments of the present invention have been shown and described it is to be understood that the present invention is subject to many modifications and changes without departing from the spirit and scope of the claims presented herein.

I claim:

1. A play structure comprising:

two side supports;

a header connecting the tops of said side supports such that said side supports are spaced to define a pathway;

a plurality of streamers hanging from said header into said pathway, said plurality of streamers in sufficient number to form a dense surroundiing along an entire length of the defined pathway, said plurality of streamers adapted to envelop users of said play structure; and a plurality of textured protrusions attached to said side supports extending into said pathway, said protrusions in a sufficient number to form a dense covering along a substantial portion of the length of the defined pathway.

2. The play structure of claim 1 wherein said streamers are bead chain.

3. The play structure of claim 1 wherein said streamers are plastic strips.

4. The play structure of claim 1 wherein said textured protrusions are spherical.

5. The play structure of claim 1 wherein said textured protrusions include feathers.

6. The play structure of claim 1 wherein said textured protrusions include fibrous bristles.

7. A play structure comprising:

two substantially parallel, substantially vertical side supports of substantially the same height;

feet disposed on the bottom of said side support to maintain the side supports in a vertical orientation;

a horizontal header connecting the tops of said side supports such that said side supports are spaced to define a pathway;

a plurality of streamers hanging from said header into said pathway, said plurality of streamers in sufficient number to form a dense surrounding along a length of the entire defined pathway, said plurality of streamers adapted to envelop user; and a plurality of textured protrusions attached to said side supports extending into said pathway, said protrusions in a sufficient number to form a dense covering along a substantial portion of the length of the defined pathway.

8. The play structure of claim 7 wherein said streamers are bead chain.

9. The play structure of claim 7 wherein said streamers are plastic strips.

10. The play structure of claim 7 wherein said textured protrusions are spherical.

11. The play structure of claim 7 wherein said textured protrusions include feathers.

12. The play structure of claim 7 wherein said textured protrusions include fibrous bristles.

* * * * *

UNITED STATES PATENT AND TRADEMARK OFFICE

CERTIFICATE OF CORRECTION

PATENT NO. : 6,464,619 B1
DATED : October 15, 2002
INVENTOR(S) : Anthony Bondi

It is certified that error appears in the above-identified patent and that said Letters Patent is hereby corrected as shown below:

Column 3,
Line 8, change “surroundiing”, to -- surrounding --

Signed and Sealed this

Eighteenth Day of February, 2003

JAMES E. ROGAN
*Director of the United States Patent and Trademark Office*